US006270183B1

(12) United States Patent
Gaarder

(10) Patent No.: US 6,270,183 B1
(45) Date of Patent: Aug. 7, 2001

(54) PRINTHEAD SERVICING TECHNIQUE

(75) Inventor: Glenn Gaarder, Ramona, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/115,153

(22) Filed: Jul. 14, 1998

(51) Int. Cl.[7] ..... B41J 2/165
(52) U.S. Cl. ..... 347/29; 347/33; 347/36
(58) Field of Search ..... 347/29, 33, 36, 347/37, 19

(56) References Cited

U.S. PATENT DOCUMENTS 3,898,671 * 8/1975 Berry et al. ..... 347/76
5,148,203 * 9/1992 Hirano ..... 346/140 R
5,621,441 4/1997 Waschauser et al. ..... 347/33
5,644,347 7/1997 Schwiebert et al. ..... 347/33
5,663,751 9/1997 Holbrook ..... 347/22
5,680,162 * 10/1997 Taylor et al. ..... 347/35

* cited by examiner

*Primary Examiner*—N. Le
*Assistant Examiner*—Shih-Wen Hsieh

(57) ABSTRACT

A small footprint device, such as an inkjet printer, having a set of printhead cartridges for applying ink droplets to a medium sheet, the printer including a housing having a pair of side plates. A platen, mounted in the housing between the side plates, helps to define a centrally disposed print zone. Sets of centrally disposed wiper openings, and cap openings, within the platen, help to facilitate, respectively, printhead cartridge wiping services before the medium sheet has passed through the print zone and printhead capping services after the medium sheet has passed through the print zone. A set of rib members extend upwardly from the platen top surface for substantially avoiding residual ink contamination on the underside of the medium sheet as it passes through the print zone.

10 Claims, 9 Drawing Sheets

PRINTHEAD SERVICING TECHNIQUE

This application is related to U.S. Pat. No. 5,886,714, granted Mar. 3, 1999. This application is assigned to the same assignee as said patent, said patent being incorporated herein by reference.

BACKGROUND OF THE INVENTION

The present invention relates generally to inkjet printing and, more particularly to inkjet printers having on line service stations having spittoons, wipers for wiping inkjet orifices and orifice caps for capping an array of nozzles on a printhead.

Conventional inkjet print engines contain three primary components which are generally organized in series. These components are the platen (including a print zone) the spittoon, in which excess print drops are disposed, and the service station where cartridge wiping and capping functions occur.

In a conventional inkjet print engine, there may be two or more ink cartridges, or printheads, mounted side by side on a transversing carriage which moves substantially perpendicular to the path of media, such as paper, which pass through the machine to be printed upon. Caps are used to prevent the cartridges from drying out during periods of non-use and they are spaced at a center to center distance of the cartridges, as the cartridges are mounted in the carriage, so that each cartridge can be simultaneously capped during periods of inactivity.

Wipers for cleaning the cartridge nozzles during servicing are often mounted on the same center to center distance of the cartridges mounted in the carriage. This allows the wipers to move in synchrony while simultaneously wiping the cartridges. This feature renders the wipers capable of being actuated by a common mechanism.

The spittoon can be one common receptacle for receipt of excess ink drops from the cartridges, although in some cases incompatibilities between inks has resulted in the use of separate spittoons.

In conventional inkjet printers, the three above described components are disposed linearly with a consequent unwanted increase in the width of the finished inkjet engine. In recognition of the problem presented by a wide system, an attempt at optimization, such as staggering the wipers between the caps, has been made. Even here, however, the width of the inkjet printer is the sum of service station width (comprised of capping width, plus one wiper, since the other wiper is disposed between the two caps) plus the platen (having a width at least equal to the width of the media to be printed upon), plus the width of the two spittoons.

As a limitation generally recognized in any attempt to optimize printer design, the spittoons should be located outside the platen area, or print zone, since, during printing the cartridges spit droplets at the same time a sheet of media is being printed on. The caps, on the other hand, can be inside the print zone since the cartridges require capping only during non-use.

With regard to printhead wiping during a print job, some conventional print engines have used a technique of wiping in the middle of the print job. As the carriage is driven to the side over the service station, cartridge wiping occurs after which the carriage is returned to the platen to continue printing on the media. While this approach may result a narrower print engine, such mid-page wiping is detrimental because of "wait banding". This is often seen as a white streak across the media caused by a difference in timing from print swath to print swath during the printing process.

Further, dimensional hygroscopic limitations may cause problems. This is seen especially in paper media, wherein time constants can cause a different amount of expansion in the print media, depending upon how long the previous swath has absorbed the ink deposited thereon. This difference of expansion can cause swath to swath advance errors between swaths with no wiping, as compared to swaths with wiping.

In view of the foregoing, it is apparent that there is a need for a narrower print engine which would consume less desk space for the user. Among advantages of such a narrower print engine would be shorter carriage travel over a shorter slider rod. This would result in a more efficient printer which would be sturdy in construction. Advantageously, such a printer would result in lower product weight and cost.

While the following detailed description relates to inkjet printers, it will be recognized that the principles set forth apply also to a number of small footprint devices, such as copiers, fax machines, scanners and combinations thereof.

DISCLOSURE OF THE INVENTION

In a presently preferred embodiment of the invention disclosed herein, there is provided a small footprint device, such as an inkjet printer, having a set of printhead cartridges for applying ink droplets to a medium sheet, the printer including a housing having a pair of side plates. A platen, mounted in the housing between the side plates, helps to define a centrally disposed print zone. Sets of centrally disposed wiper openings, and cap openings, within the platen, help to facilitate, respectively, printhead cartridge wiping services before the medium sheet has passed through the print zone and printhead capping services after the medium sheet has passed through the print zone. A set of rib members extends upwardly from the platen top surface for substantially avoiding residual ink contamination on the underside of the medium sheet as it passes through the print zone.

The present invention affords several advantages. In the case of an inkjet printer, for example there is provided a small footprint device which is narrower than conventional printers. This is accomplished by moving the service station to a location within the platen area, or print zone, thereby intercepting the media travel path. The result is an inkjet printer having a smaller desktop footprint that can be produced with less weight and at lower cost. In addition, a sturdier printer is possible. Since printhead servicing is performed in the print zone, the distance of carriage travel is reduced. As a result, the carriage slider rod has approximately the same length as the main media drive shaft and both can be mounted between a pair of side plates. This results not only in static and system dynamic advantages but also in a printer which, because of a reduction in essential parts, is easier to assemble than conventional printers.

Further, a substantially coequal slider rod and main drive shaft enable use of a large drive gear at an end of the drive shaft, thereby eliminating concern for clearance of a printhead carriage over the gear. Similarly, use of a larger encoder is enabled, thereby improving the quality of the print document.

A still further advantage of the present invention is that the printhead service station is placed in proximity to the main drive shaft so that a drive shaft driven shifting mechanism can be utilized to drive wiping and capping operations. In this manner, the conventional service station motor is eliminated.

In view of the foregoing, an inkjet printer embodying the presently preferred embodiment of the invention is smaller and sturdier in construction and is mechanically simpler than conventional printers, requiring fewer parts to assemble.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
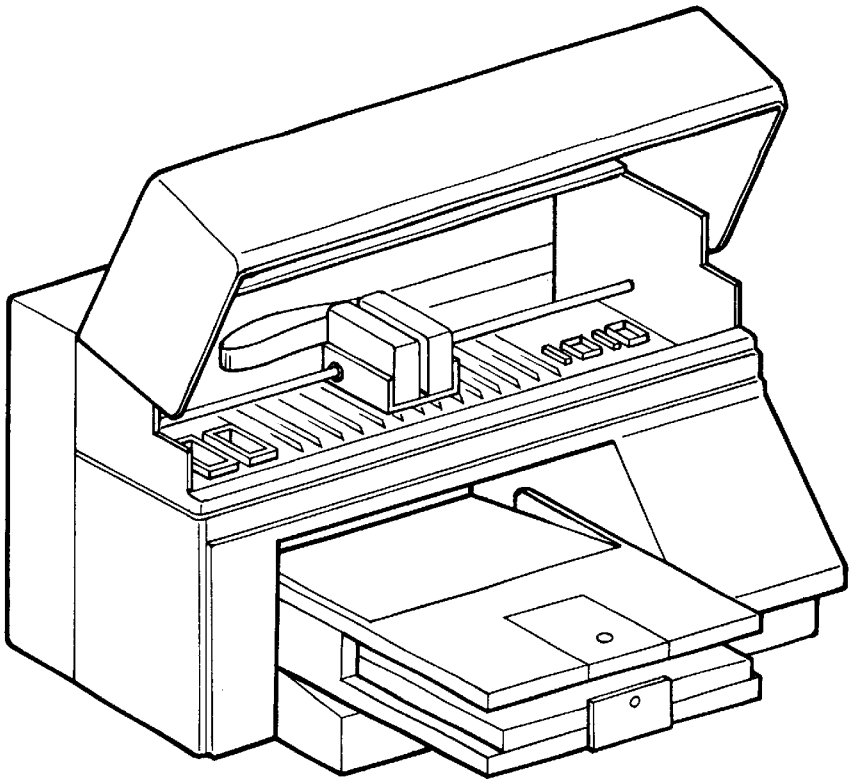
FIG. 1 (PRIOR ART)
FIG. 1 is a perspective view of a prior art inkjet printer, having two cartridges.

As shown in the drawings for purposes of illustration, the invention is embodied in a novel inkjet printer having a substantially narrower footprint than that of a conventional printer. This is accomplished by locating the service station within the platen, specifically within the print zone. A plurality of openings formed in the platen enable the service station wipers and caps to be lifted above the platen in order to service the cartridges, or printheads. A printer according to the invention provides a sturdier and more efficient small footprint device that affords the additional advantages of being lighter in weight and lower in cost than conventional printers.

Further, the present preferred embodiment of the invention, by reducing the length required for the carriage slider rod, makes it possible to mount the slider rod and the main drive shaft on the same printer side plates. The result is a printer that is easier to assemble and one that has improved static and system dynamic characteristics.

In addition, the preferred embodiment of the invention utilizes a slider rod which is substantially equal in length to the main drive shaft. Because of this factor, a larger than conventional drive gear at the end of the media drive shaft can be used, without unnecessarily extending the drive shaft to the side of the printer, since there is no longer any need for the carriage to clear the drive gear as the carriage moves to an externally located service station.

It will be recognized that a larger drive gear results in a proportionally smaller angular error induced by a given tooth to tooth error on the gear tooth profile. This result has been attempted in conventional printers by utilizing an extended drive shaft which raises production costs. Additionally, since inkjet printers are not rigid, use of an extended drive shaft usually requires three journals (which is an over constrained condition presenting tolerance problems). The preferred embodiment of the invention provides the advantages of an extended shaft while requiring only two journals.

Further, because of the geometry resulting from use of a rod and drive shaft of generally equal length, a larger than conventional encoder can be installed at the end of the drive shaft. This factor also results in improved printer output since a dimensional error in the encoder reading translates inversely with the radius of the encoder disk to an angular error on the main media drive shaft. The likelihood of such an error is reduced when a larger encoder can be utilized.

In summary, there is provided a novel inkjet printer, having a smaller footprint than that of conventional inkjet printers yet having a capability for producing an improved product because of its capacity for accommodating a larger than conventional drive gear and a larger than conventional encoder.

Before discussing in detail the construction of the presently preferred embodiment of the present invention, it will be helpful to review the prior art with reference to FIG. 1. Here, there is shown an inkjet printer 5 which includes an input tray 12 for holding a stack of medium sheets such as a medium sheet 15. Each medium sheet 15 passes over a platen 17 having a print zone 14 to be fed from the exit 18 into the output tray 16.

A movable carriage 26 holds printhead cartridges 22 and 24 which, for example, may hold black in one and a tri-color ink in the other. During a print operation, the carriage 26 moves transversly along a slider rod 28, across the printer body in a direction perpendicular to the path of travel of the medium sheet 15 through the printer. A trailer cable 26*a* enables electrical continuity while the carriage 26 traverses the slider rod 28. Driving of the medium sheet 15 through the printer 5, and operation of the carriage 26 as it traverses back and forth across the medium sheet 15 are controlled by a controller (not shown) which additionally controls the various ink nozzles on each print cartridge 22 and 24 so that they are selectively fired at the appropriate time to deposit ink on the medium sheet 15 in the print zone 14. After completion of a print job, the medium sheet 15 passes through the exit 18 and into the output tray 16.

A pair of spittoons 31 and 33, for receiving ink generated during a spitting operation, are located on one side of the printer 5 lateral to the platen 17. On the other side of the platen 17, opposite the location of the spittoons 31 and 33, there is located a service station, generally referred to by the reference numeral 13. The service station 13 contains a pair of wipers 27 and a pair of caps 29 each being alternately disposed therewithin. It will be noted that the wipers 27 and the caps 29 are fixed in a spaced relationship to conform to the center to center distances between the print cartridges 22 and 24.

It is clear, by reference to FIG. 1, that the width of the inkjet printer 5, in large measure, is defined by the travel path of the carriage 26 in the print zone 14 plus the service station 13.

Referring now to the drawings in detail wherein like numerals refer to like elements throughout the several views and in particular, to FIG. 1 thereof, there is shown an inkjet printer 10 which is narrower, sturdier and less expensive to manufacture, as contrasted with conventional printers. The elements enabling these features will be illustrated as the several figures are discussed. The printer 10 functions in an analogous manner to the printer 5, having several identical elements. For the sake of convenience, such elements have identical reference numerals in the several views shown herein.

Figure 2:
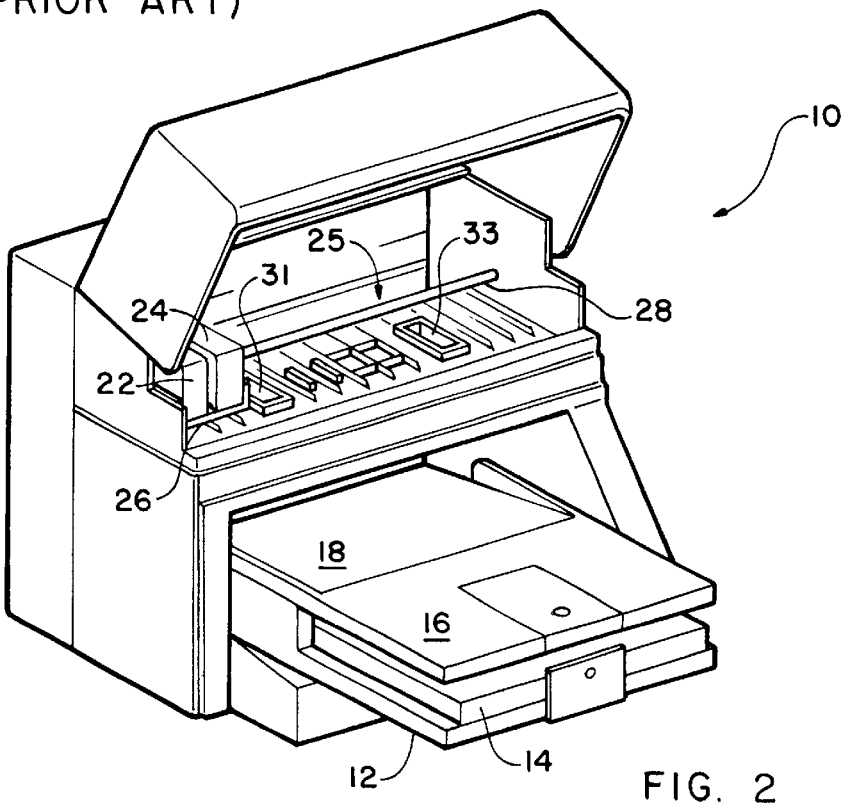
FIG. 2 is a perspective view of a presently preferred embodiment of an inkjet printer showing the service station location of the invention.

With reference to FIG. 2, in a manner similar to that discussed with regard to the printer 5, in the inkjet printer 10, the medium sheet 15 is fed from an input tray 12 to receive ink from print cartridges 22 and 24 supported by a carriage 26 which travels along a slider rod 28 in a direction transverse to the direction of travel of the medium sheet 15. The slider rod 28 is fixed between a left side plate 34 and a right side plate 36. A trailer cable 26*a* is attached to the carriage 26. In a manner similar to that of the printer 5, printing takes place in a print zone 14.

A pair of spittoons 31 and 33 are utilized, but in the printer 10, the spittoons are separated with the spittoon 31 being disposed laterally to the platen 17 while the spittoon 33 is disposed laterally of the platen 17 at a location in the printer 10 opposite that of the spittoon 31.

While there are some similarities between the printer 5 and the preferred embodiment 10, there are also substantial differences. For example, in the preferred form of the invention, a service station, generally indicated by the reference numeral 25, containing a pair of wipers 27 and a pair of caps 29, is located within the platen 17 in the area of the print zone 14. As seen best in FIG. 2A, a plurality of openings 19 is formed in the platen 17 to enable the wipers 27 and the caps 29 to be lifted over the platen 17 to contact the cartridges 22 and 24 for servicing thereof.

Figure 2A:
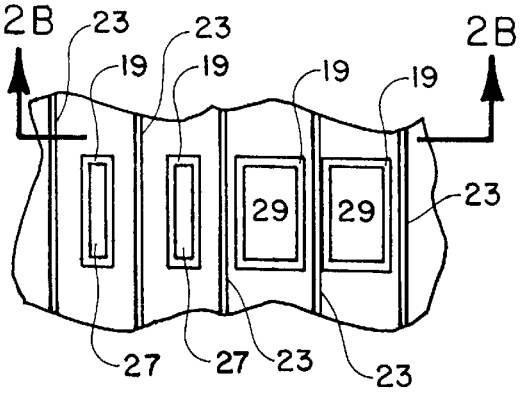
FIG. 2A is a pictorial partial view of a portion of the inkjet printer shown in FIG. 2.
Figure 2B:
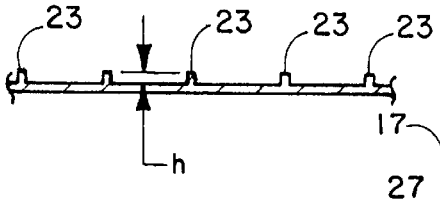
FIG. 2B is a sectional view taken along the line 2B—2B of FIG. 2A.

It will be noted that the novel location of the service station 25, within the platen 17, results in a substantial reduction in the width of the printer 10. As noted above, the service station 25 contains a pair of wipers 27 and a pair of caps 29 and, in a preferred embodiment, the wipers 27 are arranged in a side by side relationship as are the caps 29. As shown in FIG. 2B, upstanding ribs 23 extend from the top surface of the platen 17 to a height h of about 20 millimeters. The rib members 23 support the medium sheet 15 from below as it passes through the print zone 14 and, in addition, hold the medium sheet 15 at a sufficient distance above the service station 25 to substantially avoid residual ink contamination of the underside of the medium sheet 15 as it passes through the print zone 14. The relationships among the rib members 23 and the wipers 27 and the caps 29 of the service station 25 are best shown in FIG. 2A.

Thus, it will be readily apparent that placement of the service station 25, within the print zone 14, allows the width of the inkjet printer 10 to be reduced substantially. In addition, as discussed more fully below, this placement affords beneficial engineering advantages. The results are a sturdier, more compact and more economical construction which has an improved capability for producing a very high quality product.

Figure 3:
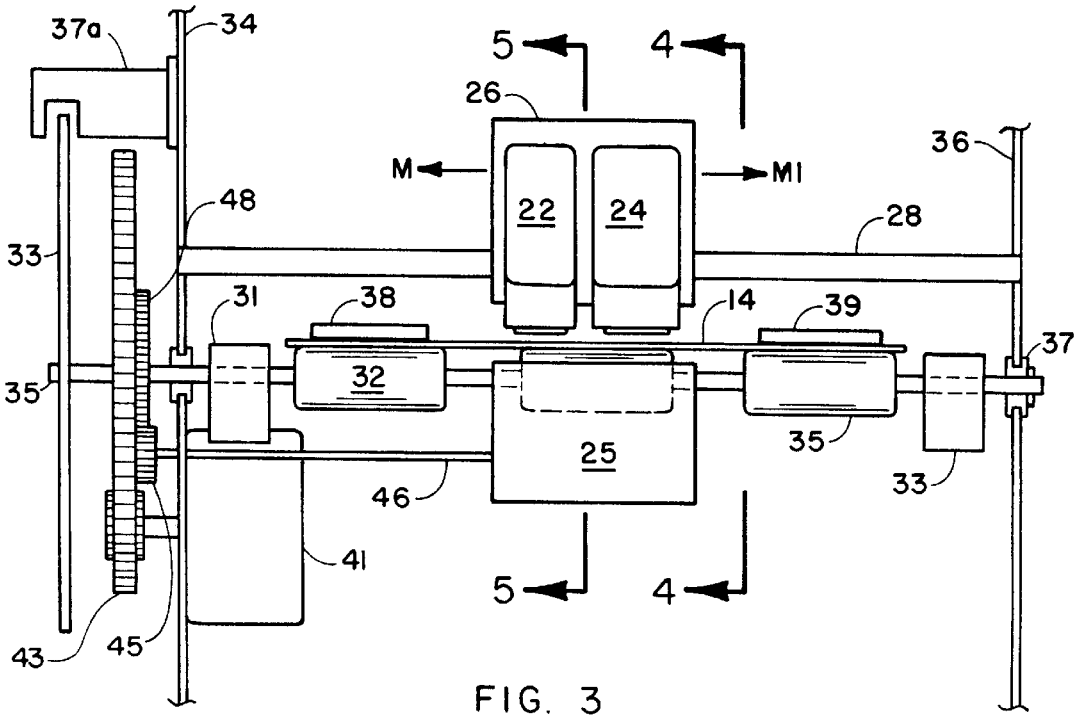
FIG. 3 is a diagrammatic view of a mechanism for controlling media drive path and service station functions.
Figure 6B:
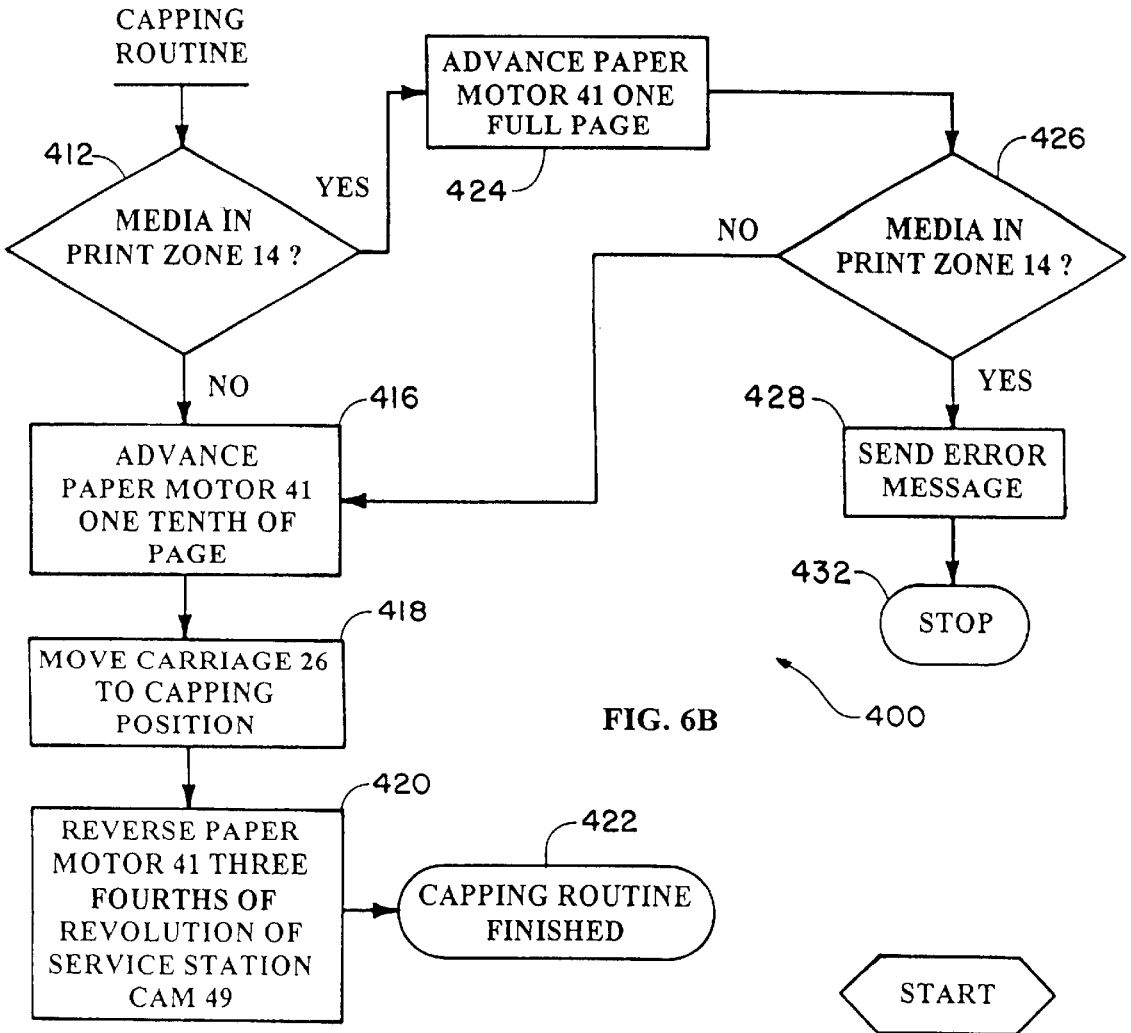
FIG. 6B is a flow chart showing a typical sequence of events which occur during a capping routine in the embodiment shown in FIG. 6.

Referring now to FIG. 3, the details of construction of the inkjet printer 10 will be seen in greater detail. Here there is shown side plates 34 and 36 having the carriage slider rod 28 fixed between them. The carriage 26, having an opening 51 for engagement of the slider rod 28, carries print cartridges 22 and 24 along the slider rod 28 in the direction indicated by the arrows M and M1, said direction being perpendicular to the direction of travel of the medium sheet 15. Travel of the carriage 26 along the slider rod 28 is controlled in a conventional manner by a carriage drive motor (not shown) which is electrically coupled to a main drive shaft 35.

The main drive shaft 35, more fully discussed below, is journaled for rotational movement at a bushing 37 in the right side plate 36 and at a bushing 37 in the left side plate 34 where it is coupled to a main drive gear 43. An encoder disk 33, read by an encoder 37*a*, is fixed to the main drive shaft 35 for control of rotational movement thereof.

An advantage of the invention is that, because of the geometry resulting from the use of a slider rod 28 and drive shaft 35 of substantially the same length, a larger than conventional drive gear can be located at the end of the drive shaft 35 since there is no need for clearance between the carriage 26 and the main drive gear 43. Thus, an advantage is afforded by the present invention as contrasted with conventional inkjet printers in which, without an extended shaft, the cartridge must pass over the main drive gear to reach the spittoons or service station. As a result, a larger drive gear may be employed in the preferred embodiment of the invention and it is possible to produce a more accurate print job than produced by conventional printers. The larger drive gear is clearly shown in FIG. 3, where it will be noted that the distance R1, the radius of the main drive gear 43, is substantially greater than r, the distance from the axis of the drive shaft 35 to the bottom of the printhead 22.

In a similar manner, the preferred embodiment of the invention enables the beneficial use of a larger than conventional encoder. In this regard, it may be noted that the radius R of the encoder disk 33 is also substantially greater than r.

There will be considered now a print operation in which the medium sheet 15 is moved through the printer 10. The sheet 15 moves between pinch rollers 38 and 39 which pinch the medium sheet 15 between drive rollers 32 mounted on and rotated by the drive shaft 35. A media drive motor 41, controlled by a controller (not shown) turns a gear 42 which engages the main drive gear 43. The main drive gear 43, in turn, rotates a gear 48, and through a clutching mechanism, described more fully below, rotates a cam shaft 46 to control operation of the wipers 27 and caps 29 in the service station 25. A one way clutch (not shown) in cooperation with the gear 45 causes rotation of the drive shaft 46 for control of the service station 25 operations.

During printing, the printheads or cartridges 22 and 24, carried by the carriage 26 along the slider rod 28, has been positioned for depositing indicia upon the media sheet 15. Before and after printing a page of a print job, printhead wiping occurs and, upon completion of the print job, a capping function at the service station 25 is activated. In general, control of the service station 25 functions include movement of its components in a direction perpendicular to the path of travel of the media sheet 15, as generally indicated by the double arrow P. It will be recognized that moving the wipers 27 in an orthogonal direction is sometimes required and such action can be accomplished by the mechanism described herein.

Figure 4:
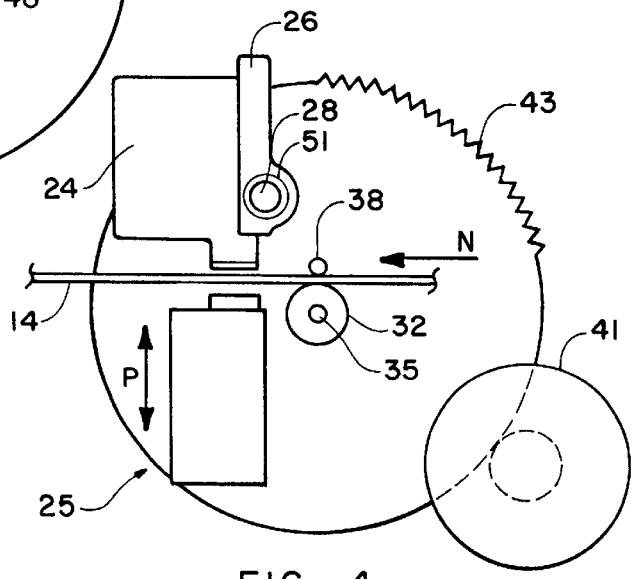
FIG. 4 is a sectional view taken along the line 4—4 of FIG. 3.
Figure 4A:
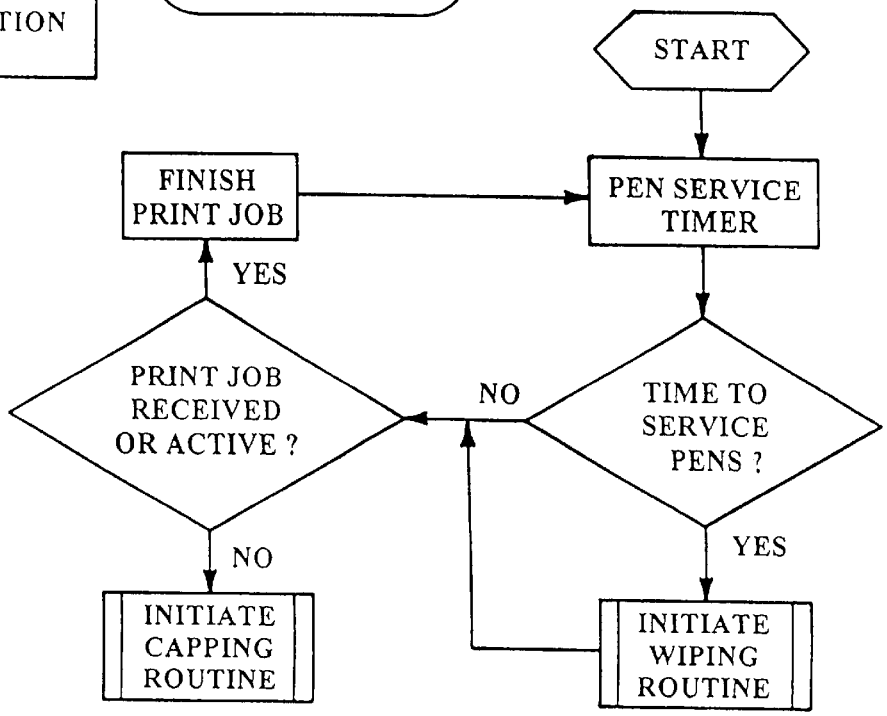
FIG. 4A is a flow chart showing a typical sequence of events which occur during wiping and capping routines in the several embodiments of the present invention.

Referring now to FIGS. 4 through 8B, there is shown generally in FIG. 4, the structure and components of the inkjet printer 10 which are common to embodiments subsequently described. FIG. 4A depicts a flow chart 70 showing generally the decisions and steps entailed in the wiping and capping operations of the printer 10 as shown in the several embodiments set forth below. As shown in the flow chart 70, from a step 72 the system goes to a go to or call step 74 that calls a wiping subroutine 76. The wiping subroutine 76 will be discussed hereinafter in greater detail in respect of the several embodiments.

After the wiping subroutine 76 has been completed, the system returns to the main program advancing to a decision step 82. At the step 82 a determination is made whether a print job has been received or is active. If this condition exists, the system goes to a wait step 84 to allow the print job to be completed. From the step 84, the system returns to the pen service timer step 72 and proceeds as previously described. If the determination at step 82 is negative, a capping subroutine 86 is initiated.

Figure 5:
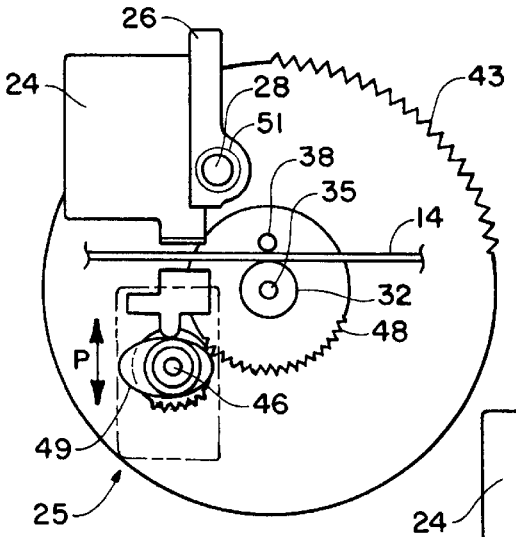
FIG. 5 is sectional view taken along the line 5—5 of FIG. 3.
Figure 5A:
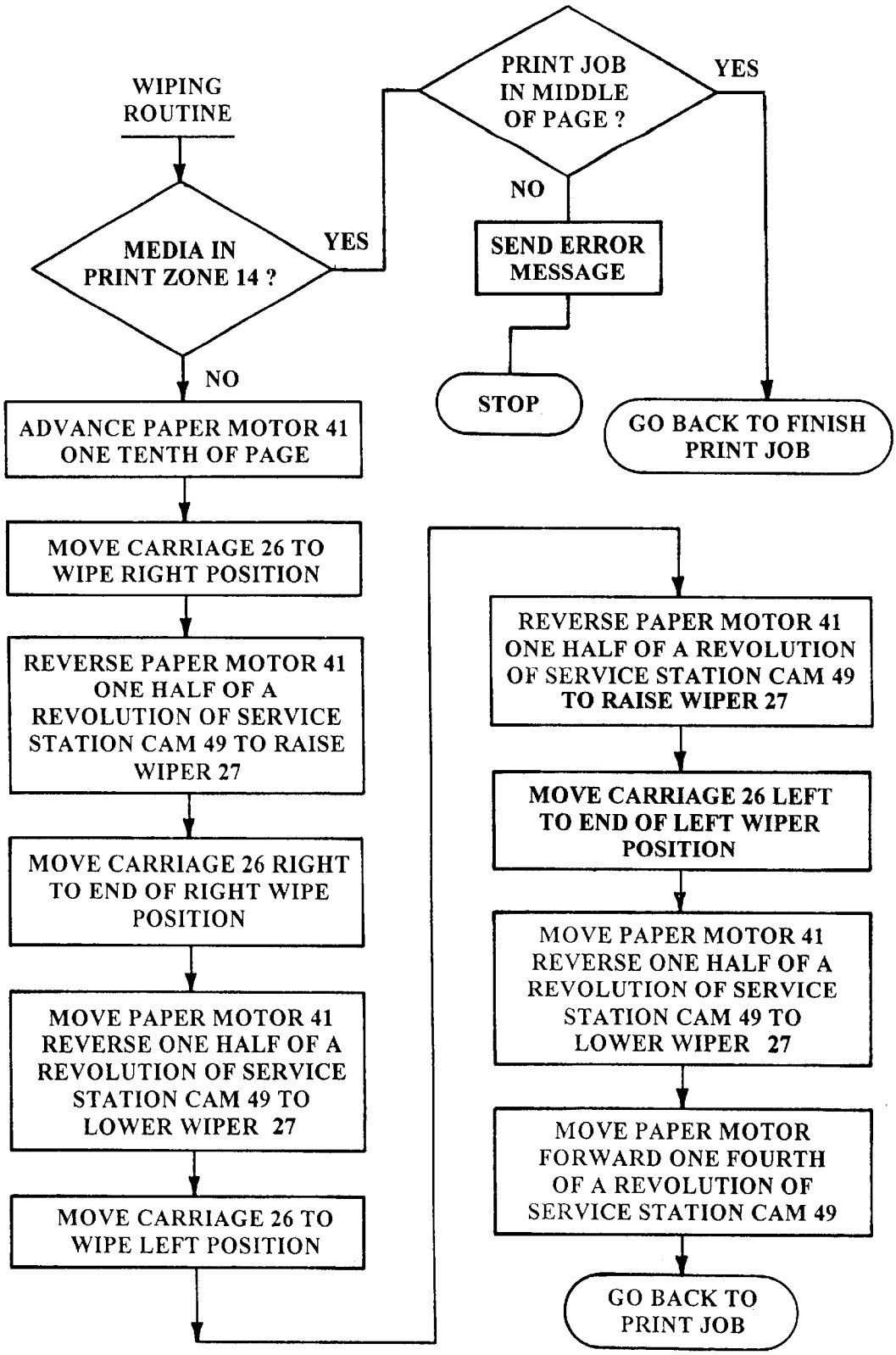
FIG. 5A is a flow chart showing a typical sequence of events which occur during a wiping routine in the embodiment shown in FIG. 5.
Figure 5B:
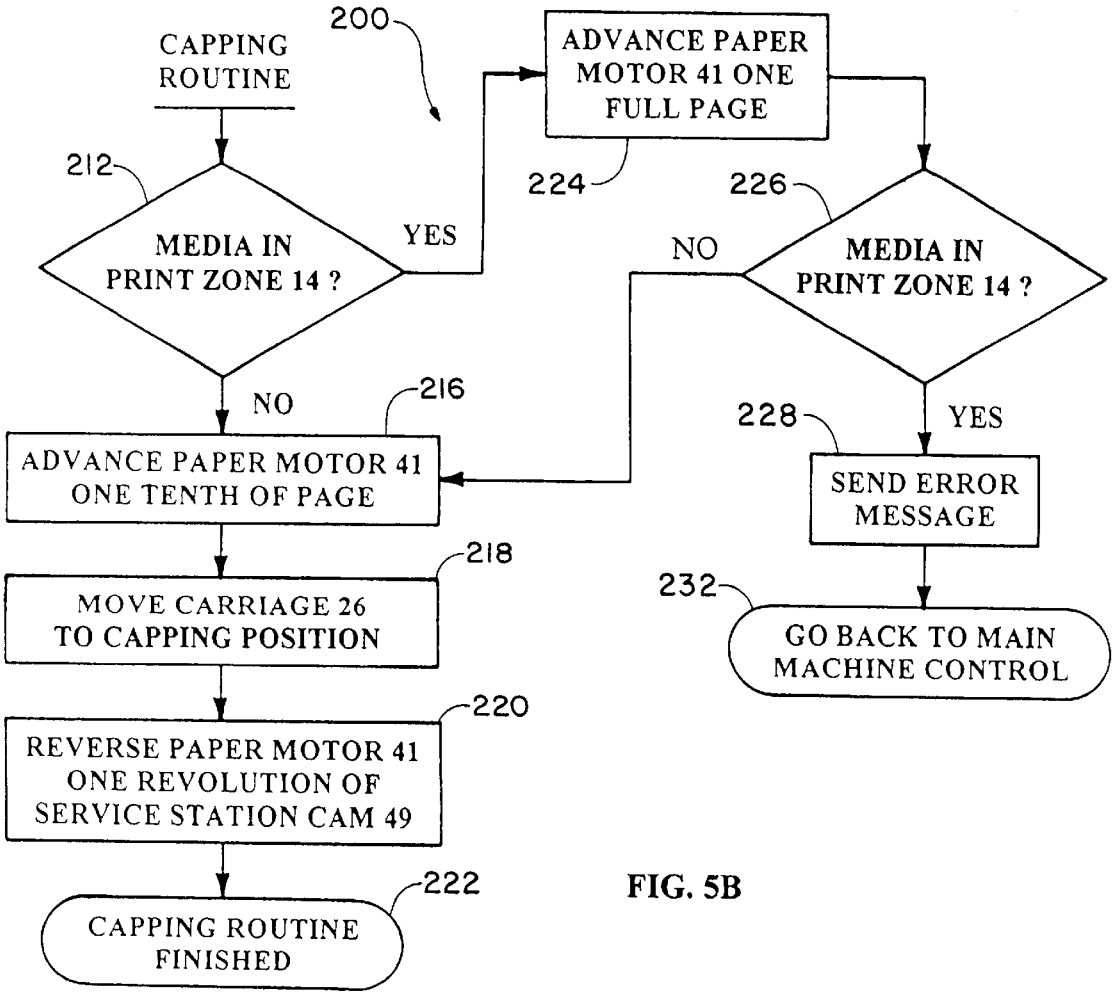
FIG. 5B is a flow chart showing a typical sequence of events which occur during a capping routine in the embodiment shown in FIG. 5.
Figure 6A:
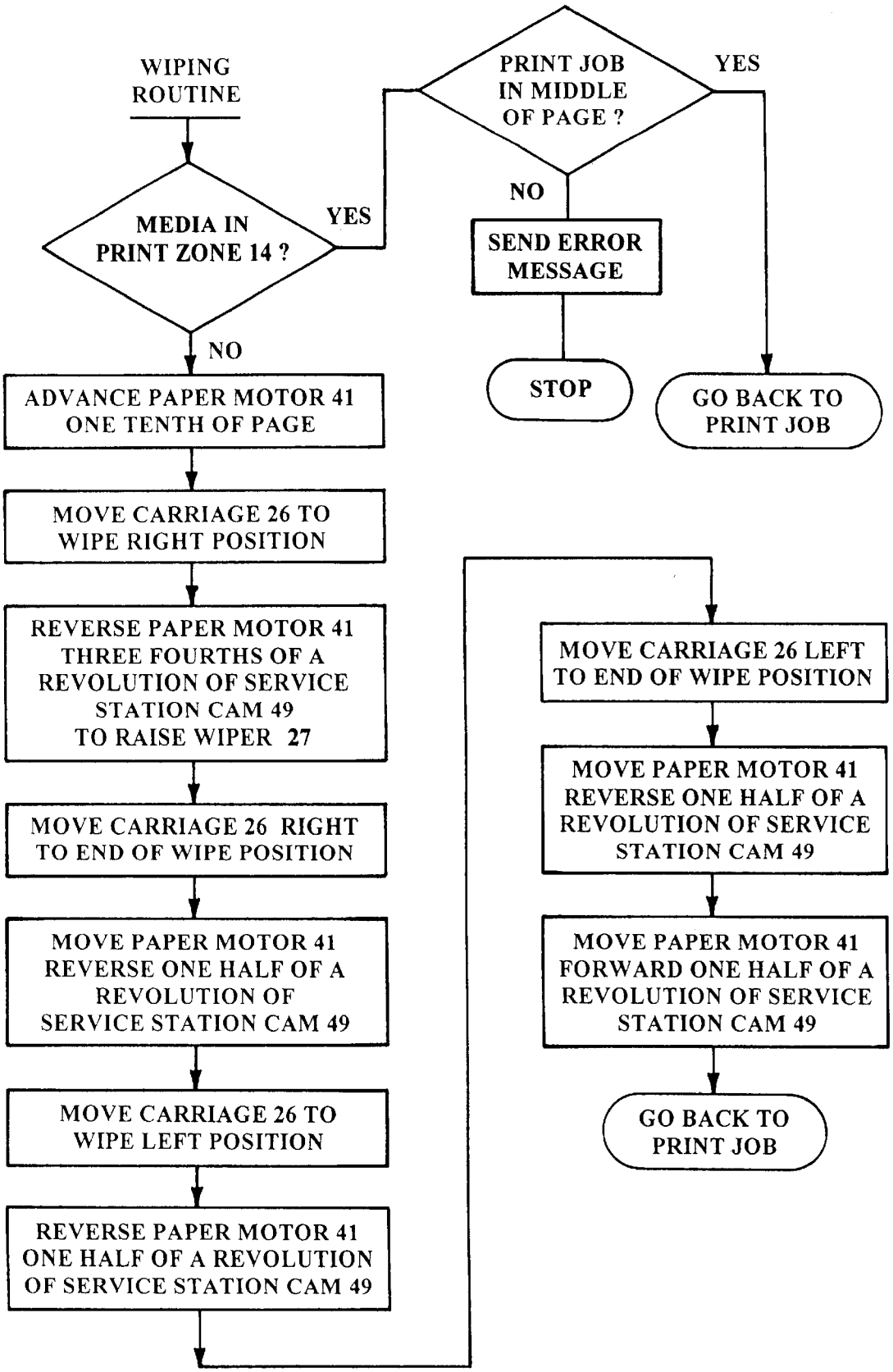
FIG. 6A is a flow chart showing a typical sequence of events which occur during a wiping routine in the embodiment shown in FIG. 6.

With reference now to FIGS. 5, 5A and 5B, there is shown a first embodiment of a service station activation mechanism 52. For convenience, with respect to the mechanism 52 and the other embodiments thereof set forth below, the motor 41 and the gear 42 are not shown. Additionally, while one wiper 27 is shown, it will be understood that the mechanism 52 functions in an identical manner for controlling the operations of the other wiper 27 and of the caps 29. The elements discussed with respect to FIG. 4 are present and perform as previously described. In the service station activation mechanism 52, a one-way clutch functions so that when the medium sheet 15 is advancing through the print zone 14, in a direction indicated by the arrow N, the one way clutch is being overdriven on the shaft 46 so that a cam 49, fixed thereto, is not rotating. It is recognized that a rack and pinion or other mechanism can be utilized to move the wipers 27 in an orthogonal direction, i.e., in a motion other than simply up and down, for efficient wiping.

The operation of the service station activation mechanism 52 is shown in the flow charts of FIGS. 5A and 5B. The sequences shown can be programmed, in a conventional manner, into the memory of a printer controller (not shown) or implemented as firmware.

With regard to the wiping operation of the service station activation mechanism 52, a wiping routine 100 is initiated in the manner set forth in step 76 of FIG. 4A and, at a decision step 112 a determination is made whether media are present in the pint zone 14. If this condition exists, the system goes to a decision step 114 to determine if a print job is in the middle of a page and if this is the case, the system goes to a wait step 115 to allow the print job to be completed. If the determination at the step 114 is negative, the system goes to a call step 117 and an error message is sent, since if there is no print job there should be no media in the print zone, and at a wait step 142, the routine 100 is stopped.

If the response at the decision step 112 is negative, indicating that no media is present in the print zone 14, and further denoting a suitable time to wipe, at step 116 the motor 41 advances the paper one tenth of the page to kick out any media remaining in the printer 10. This step is followed by a step 118 and the carriage 26 is moved to a wipe right position and by a step 120 in which the motor 41 reverses (for engagement of the one way clutch) one half of a revolution of the service station cam 49 to raise the wiper 27 into position for wiping the cartridges 22 and 24. This accomplished, at step 122 the carriage 26 is moved to the end of the right wipe position and at step 126 the motor 41 reverses one half of a revolution of the service station cam 49 to lower the wiper 27. After the wiper 27 has been lowered, at step 128 the carriage 26 is moved to a wipe left position whereupon at step 132 the motor 41 causes one half of a revolution of the cam 49 to raise the wipers 27. This accomplished, at step 134 the carriage 26 is moved left to the end of a left wipe position and with the carriage 26 thus positioned, at step 136, the motor 41 causes a reverse one half revolution of the service station cam 49, thereby lowering the wipers 27. With the wiping routine now completed, at a step 138, the motor 41 moves forward one fourth of a revolution of the service cam 49, to disengage the one way clutch, and at step 140 the system returns to the print job. In regard to the wiping routine 100, it will be noted that each wipe comprises two moves, one to the right and one to the left. It will be recognized that a single algorithm can be used for an orthogonal wiping system.

Upon completion of the print job, a capping routine 200 is initiated in the manner set forth in step 86 of FIG. 4A and, at a decision step 212 a determination is made as to whether media are present in the print zone 14. If not, at a command step 216, the motor 41 advances the paper one tenth of the page to engage the one way clutch, and at step 218 moves the carriage 26 into a capping position. This is followed, at step 220, when the motor 41 reverses one revolution of the service station cam 49, thereby raising the caps 29 to seal off the orifices of the print cartridges 22 and 24 and, upon accomplishment of this step, the system goes to a wait step 222 and the capping routine is finished. If the decision at the step 212 is affirmative, the system goes to a command step 224 the motor 41 advances a distance of one full page to expel any media which are erroneously in the media path. This is followed by a decision step 226 in which a determination is made as to whether media are present in the print zone 14 and if this condition exists, the system goes to a step 228 and an error message is generated. This is followed by a wait step 232 and the system returns to a printer main control since either a medium sheet 15 is jammed in the print zone 14 or the media sensor has failed. On the other hand, if a determination at the decision step 226 is negative, the system returns to the step 216 to allow the capping routine to continue.

Figure 6:
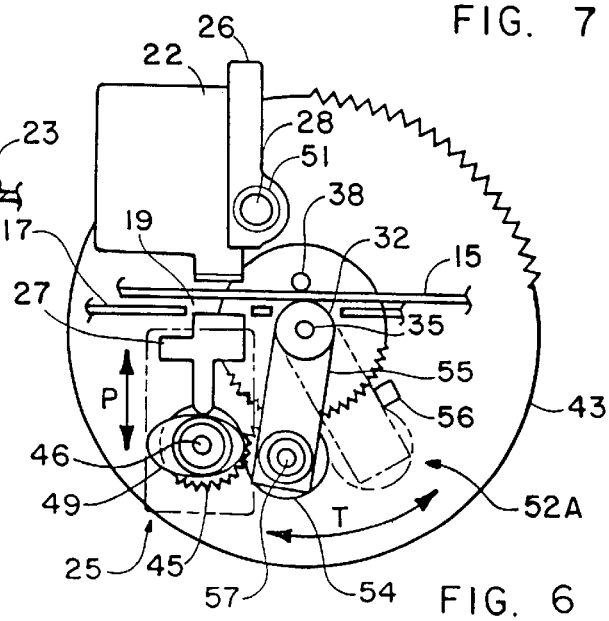
FIG. 6 is a diagrammatic view of another embodiment of a mechanism for controlling media drive path and service station control functions.

Referring now to FIG. 6, there is shown a second embodiment of a service station activation mechanism 52A utilized in the printer 10. In this embodiment, a swing arm 55 is used as a technique of implementing a one-way clutch. The swing arm 55 is connected to the main drive shaft 35 and is coupled to a swing arm gear 54 at an axle 57. As the main drive shaft 35 is rotated in the forward direction, driving the media sheet 15 through the print zone 14, the swing arm 55 is driven, as shown by the arrow T, away from engagement with the cam shaft 46. Movement of the swing arm 55 is halted at a stop 56 located on the side plate 34. After the media sheet 15 is expelled from the printer 10, the main drive roller 32, under control of the motor 41, is reversed. There is intentional drag between the swing arm 55 and a swing arm gear 48 to drive the swing arm 55 in the direction of the gear 48. The reversing motion of the main drive shaft 35 swings the swing arm 55 so that the swing arm gear 54 engages the cam 49. At this point, the cam shaft 46 is engaged by the main drive shaft 35 and the cam 49 is rotated to lift and lower the wipers 29 and the caps 27 in a controlled manner.

With regard to the wiping operation of the service station activation mechanism 52A, a wiping routine 100 is initiated in the manner set forth in step 76 of FIG. 4A and, at a decision step 312 a determination is made whether media are present in the pint zone 14. If this condition exists, the system goes to a decision step 314 to determine if a print job is in the middle of a page and if this is the case, the system goes to a wait step 315 to allow the print job to be completed. If the determination at the step 314 is negative, the system goes to a call step 317 and an error message is sent, since if there is no print job there should be no media in the print zone 14, and at a wait step 342, the routine 300 is stopped.

If the response at the decision step 312 is negative, indicating that no media are present in the print zone 14, and further denoting a suitable time to wipe, at step 316 the motor 41 advances the medium sheet one tenth of the page to kick out any media remaining in the printer 10. This step is followed by a step 318 and the carriage 26 is moved to a wipe right position and by a step 320 in which the motor 41 reverses three fourths of a revolution of the service station cam 49 to raise the wiper 27 into position for wiping the cartridges 22 and 24. This accomplished, at step 322 the carriage 26 is moved to the end of the right wipe position and at step 326 the motor 41 reverses one half of a revolution of the service station cam 49 to lower the wiper 27. After the wiper 27 has been lowered, at step 328 the carriage 26 is moved to a wipe left position whereupon at step 332 the motor 41 causes one half of a revolution of the cam 49 to raise the wipers 27. This accomplished, at step 334 the carriage 26 is moved left to the end of a left wipe position and with the carriage 26 thus positioned, at step 336, the motor 41 causes a reverse one half revolution of the service station cam 49, thereby lowering the wipers 27. With the wiping routine now completed, at a step 338, the motor 41 moves forward one half of a revolution of the service cam 49 to lower the wipers 27 and at step 340 the system returns to the print job. In regard to the wiping routine 300, it will be noted that each wipe comprises two moves, one to the right and one to the left. It will be recognized that a single algorithm can be used for an orthogonal wiping system.

Upon completion of the print job, a capping routine 400 is initiated in the manner set forth in step 86 of FIG. 4A and, at a decision step 412 a determination is made as to whether media are present in the print zone 14. If not, at a command step 416, the motor 41 advances the medium sheet one tenth of the page to engage the one way clutch, and at step 418 moves the carriage 26 into a capping position. This is followed, at step 420, when the motor 41 reverses one fourth of a revolution of the service station cam 49, thereby raising the caps 29 to seal off the orifices of the print cartridges 22 and 24 and, upon accomplishment of this step, the system goes to a wait step 422 and the capping routine is finished. If the determination at the decision step 412 is affirmative, the system goes to a command step 424 and the motor 41 advances a distance of one full page to expel any media which are erroneously in the media path. This is followed by a decision step 426 in which a determination is made as to whether media are present in the print zone 14 and if this condition exists, the system goes to a step 428 and an error message is generated. This is followed by a wait step 432 and the system returns to a printer main control since either a medium sheet 15 is jammed in the print zone 14 or the media sensor has failed. On the other hand, if a determination at the decision step 426 is negative, the system returns to the step 416 to allow the capping routine to continue.

Referring now to FIGS. 7, 8 and 8A and 8B, there is shown a third and preferred embodiment of a service station activation mechanism 52B for utilization in the printer 10. In this embodiment, a different method of driving the cam shaft 46 is employed. Rather than utilizing a one-way clutch, such as in the embodiments 52 and 52A, the carriage 26 is used to engage the cam shaft 46 by means of a sliding gear 45, coupled to the print motor 41 by the cam shaft 46, and a shifting fork 61. The shifting fork 61 is connected to the shaft 46. During pen servicing, the carriage 26 pushes on the shifting fork 61 and thereby pushes the sliding gear 45 into engagement with the main drive roller 32 on the main drive shaft 34. Once the main drive roller 32 is engaged, the sequence of forward or reverse moves are controlled by the drive motor 41 to actuate the cam 49 for upward or downward movement of the wipers 27 and caps 29 of the service station 25.

An advantage of the preferred embodiment 52B is that both forward and reverse motions of the motor 41 can be utilized to actuate the cam 49 whereas in the prior two embodiments, the one-way clutch would allow rotation of the cam 49 in only one direction, thereby limiting the algorithms which can be used for raising and lowering the cap and the wipers in any particular sequence.

Figure 8:
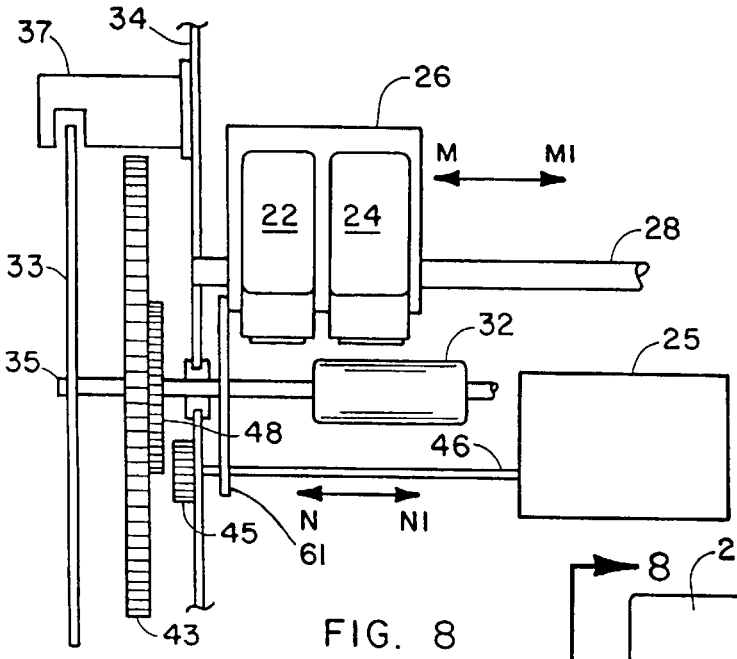
FIG. 8 is a sectional view taken along the line 8—8 of FIG. 7.

As shown in FIG. 8, the double arrow N-N1 indicates direction of movement of the gear 45 into and out of engagement with the gear 48.

Figure 7:
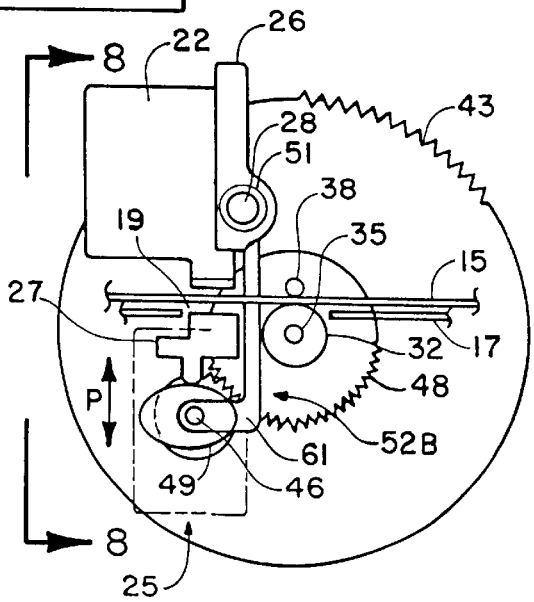
FIG. 7 is a diagrammatic view of yet another embodiment of a mechanism for controlling media drive path and service station functions.
Figure 8A:
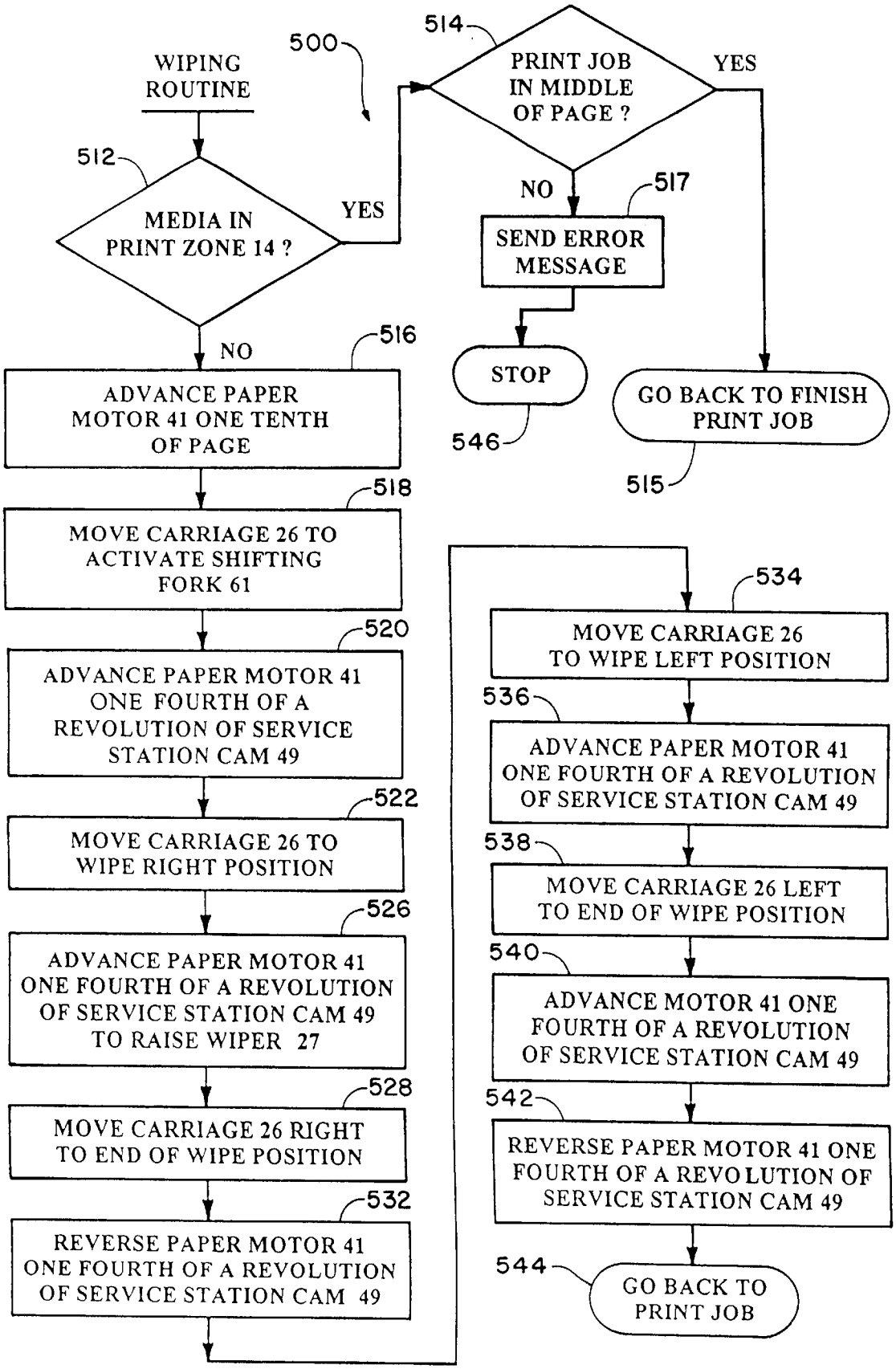
FIG. 8A is a flow chart showing a typical sequence of events which occur during a wiping routine in the embodiment shown in FIG. 8.
Figure 8B:
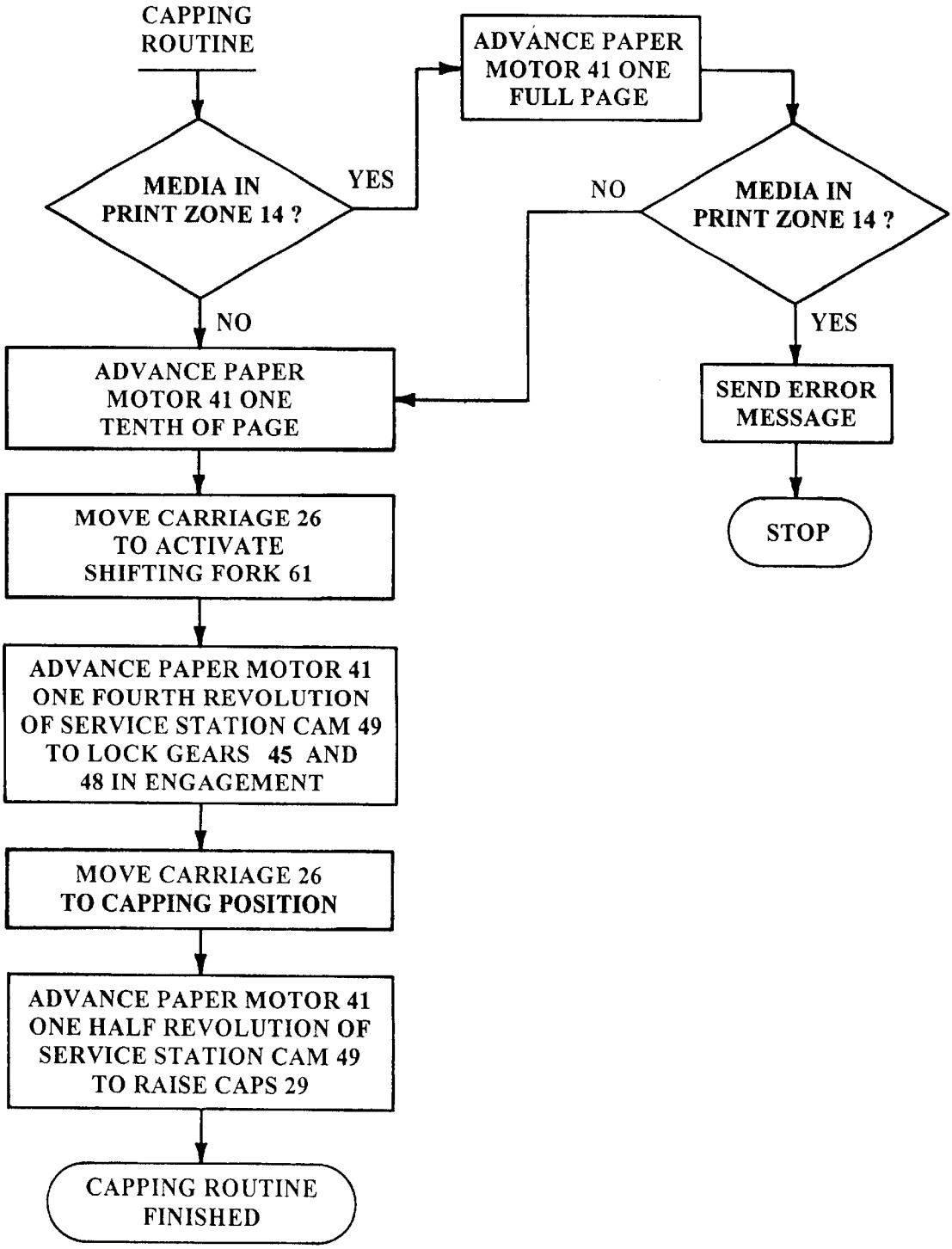
FIG. 8B is a flow chart showing a typical sequence of events which occur during a capping routine in the embodiment shown in FIG. 8.

The operation and function of the embodiment of FIGS. 7 and 8 are illustrated by the flow charts of FIGS. 8A and 8B. The sequences shown can be programmed into the memory of a printer controller (not shown) or implemented as firmware.

With regard to the wiping operation of the service station activation mechanism 52B a wiping routine 500 is initiated in the manner set forth in step 76 of FIG. 4A and at a decision step 512 a determination is made as to whether media are present in the print zone 14. If so, the system goes to a decision step 514 to determine whether the print job is in the middle of a page and, if this is the case, at a command step 515, the print job is continued. On the other hand, if the response to the decision 514 is negative, at step 517, an error message is sent and the system goes to a wait step 546 since there should be no media in the print zone 14 when an active print job is not underway.

If the response to the decision step 512 is negative, indicating that there are no media present in the print zone 14, at step 516 the motor 41 advances the paper one tenth of the medium sheet to remove any media that may not have been fully kicked out of the printer. At a step 518, the carriage 26 is moved thereby activating the shifting fork 61. This is followed by a step 520 in which the motor 41 advances one fourth of a revolution of the service station cam 49 to lock the gear 45 into engagement with the gear 43 in a conventional manner as, for example, by use of a flange on the gear 43 having a single opening for entry and exit of the gear 45. Next, at step 522, the carriage 26 is moved to the right wipe position and at step 526 the motor 41 advances one fourth of a revolution of the service station cam 49 to raise the wiper 27 into position for wiping the cartridges 22 and 24. After this is accomplished, at step 528 the carriage 26 is moved right to the end of the wipe position and at step 532, the motor 41 reverses one fourth of a revolution of the cam 49 and at step 534, the carriage 26 is moved to the left wipe position. With the carriage 26 so positioned, at step 536 the motor 41 advances one fourth of a revolution of the cam 49 to raise the wiper 27. This is followed by a step 538 in which the carriage 26 is moved to the end of the wipe position. This accomplished, at step 540 the motor 41 causes a reverse of one fourth revolution of the service station cam 49 to lower the wiper 27 after which, at step 542 the motor 41 reverses one fourth of a revolution of the cam 49 to disengage the sliding gear 45 from the gear 48. The wiping routine now completed, the system goes to a wait command 544 and the print job is resumed.

Upon completion of the print job, a capping routine 600 is initiated in the manner set forth in step 86 of FIG. 4A and, at a decision step 612 a determination is made as to whether media are present in the print zone 14. If not, at a command step 616 the motor 41 advances the medium sheet one tenth of the page to remove any media that may not have been completely kicked out. Subsequently, at step 618, the motor 41 moves the carriage 26 to activate the shifting fork 61 and at step 620 the motor 41 advances one fourth revolution of the service station cam 49 to lock the gears 45 and 48 in engagement. Upon accomplishment of this step, at step 622 the carriage 26 is moved into the capping position. Subsequently, at step 625, the motor 41 advances one half revolution of the cam 49 to raise the caps 29 to seal against the orifice plates of the print cartridges 22 and 24, thereby finishing the capping routine.

On the other hand, if a determination at the decision step 612 is affirmative, at a command step 624 the motor 41 advances the paper one full page to attempt to remove any media in the print zone 14. This is followed by another decision step 626 to determine whether media are present in the print zone 14. If no, the routine moves to the step 616, described above. If the response to the decision 626 is affirmative, at step 628 an error message is sent and at a wait step 632 the routine 600 is stopped since there exists either a media jam or printer malfunction.

While the focus of the detailed description has been on inkjet printers, it will be evident that the inventions disclosed herein are equally applicable to small footprint devices in general such as, for example, copiers, fax machines, scanners and combinations thereof. Thus, it will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A small footprint device having a set of printhead cartridges for applying ink droplets to a medium sheet, comprising:

a small footprint housing having a left side plate and a right side plate;

a slider rod mounted between said plates;

a carriage unit slidably mounted on said slider rod for holding removably the printhead cartridges;

a drive shaft mounted between said plates coupled to said carriage for driving it reciprocatively along a rectilinear path of travel extending substantially between said left side plate and said right side plate;

a platen mounted in said housing between said plates for helping to define a centrally disposed print zone within said housing, said platen including a top surface having a set of upstanding rib members extending upwardly therefrom for supporting from below a medium sheet as it passes through said print zone, said rib members extending above the top surface of said platen to substantially avoid residual ink contamination on an underside of said medium sheet as it passes through said print zone;

a set of print zone wiper openings centrally disposed within said platen for helping to facilitate a print zone wiping service for the printhead cartridges before the medium sheet has passed through said print zone;

a set of print zone cap openings disposed adjacent said set of print zone wiper openings for helping to facilitate a print zone capping service for the printhead cartridges after the medium sheet has passed through said print zone;

a service station having a set of wipers and a set of caps mounted correspondingly within said set of wiper openings and said set of cap openings for providing wiping and capping services for the printhead cartridges within said print zone; and a drive shaft mounted mechanism for controlling service station wiping and capping services, said mechanism including a drive gear mounted on said drive shaft and coupled to a cam whereby rotary motion imparted by said drive gear to said cam causes movement of said set of wipers and said set of caps wherein said mechanism further includes a swing arm mounted on said drive shaft, said swing arm including a gear for imparting rotary motion to said cam.

2. The small footprint device according to claim 1, wherein each one of said set of rib members extends to a height of about 20 millimeters above the top surface of said platen.

3. The small footprint device according to claim 1, further comprising:

a set of spittoons mounted outside of said print zone and partially adjacent said left side plate and partially adjacent said right side plate for facilitating an out of print zone wetting of the printhead cartridges during a servicing operation.

4. The small footprint device according to claim 1 wherein each of said printheads has a bottom surface and the bottom surfaces of said printhead cartridges are spaced at a distance from said drive shaft, said drive shaft including a drive gear mounted on said drive shaft, said drive gear having an axis and a radius greater than the distance from the axis of said drive gear to the bottom surfaces of said printhead cartridges.

5. The small footprint device according to claim 1 wherein said device includes encoder disk mounted on said drive shaft, said encoder disk having a radius greater than the distance from the axis of said drive gear to the bottom of said printhead cartridges.

6. A small footprint device having a set of printhead cartridges for applying ink droplets to a medium sheet, comprising:

a small footprint housing having a left side plate and a right side plate;

a slider rod mounted between said plates;

a carriage unit slidably mounted on said slider rod for holding removably the printhead cartridges;

a drive shaft mounted between said plates coupled to said carriage for driving it reciprocatively along a rectilinear path of travel extending substantially between said left side plate and said right side plate;

a platen mounted in said housing between said plates for helping to define a centrally disposed print zone within said housing, said platen including a top surface having a set of upstanding rib members extending upwardly therefrom for supporting from below a medium sheet as it passes through said print zone, said rib members extending above the top surface of said platen to substantially avoid residual ink contamination on an underside of said medium sheet as it passes through said print zone;

a set of print zone wiper openings centrally disposed within said platen for helping to facilitate a print zone wiping service for the printhead cartridges before the medium sheet has passed through said print zone;

a set of print zone cap openings disposed adjacent said set of print zone wiper openings for helping to facilitate a print zone capping service for the printhead cartridges after the medium sheet has passed through said print zone;

a service station having a set of wipers and a set of caps mounted correspondingly within said set of wiper openings and said set of cap openings for providing wiping and capping services for the printhead cartridges within said print zone; and a drive shaft mounted mechanism for controlling service station wiping and capping services, said mechanism including a drive gear mounted on said drive shaft and coupled to a cam whereby rotary motion imparted by said drive gear to said cam causes movement of said set of wipers and said set of caps wherein said mechanism further includes a shifting fork coupled to said drive shaft for imparting rotary motion to said cam when said shifting fork is moved by said carriage from a first position to a second position.

7. The small footprint device according to claim 6, wherein each one of said set of rib members extends to a height of about 20 millimeters above the top surface of said platen.

8. The small footprint device according to claim 6, further comprising:

a set of spittoons mounted outside of said print zone and partially adjacent said left side plate and partially adjacent said right side plate for facilitating an out of print zone wetting of the printhead cartridges during a servicing operation.

9. The small footprint device according to claim 6 wherein each of said printheads has a bottom surface and the bottom surfaces of said printhead cartridges are spaced at a distance from said drive shaft, said drive shaft including a drive gear mounted on said drive shaft, said drive gear having an axis and a radius greater than the distance from the axis of said drive gear to the bottom surfaces of said printhead cartridges.

10. The small footprint device according to claim 6 wherein said device includes encoder disk mounted on said drive shaft, said encoder disk having a radius greater than the distance from the axis of said drive gear to the bottom of said printhead cartridges.

* * * * *